US010950163B2

(12) United States Patent
Lai et al.

(10) Patent No.: US 10,950,163 B2
(45) Date of Patent: Mar. 16, 2021

(54) PIXEL CIRCUIT, PIXEL CIRCUIT DRIVING METHOD, AND DISPLAY DEVICE THEREOF

(71) Applicant: AU Optronics Corporation, Hsin-Chu (TW)

(72) Inventors: Po-Chun Lai, Hsin-Chu (TW); Wei-Ting Wu, Hsin-Chu (TW); Syuan Shih, Hsin-Chu (TW); Wan-Lin Chen, Hsin-Chu (TW); Ming-Yuan Tang, Hsin-Chu (TW); Wei-Hsuan Chang, Hsin-Chu (TW); Yung-Chih Chen, Hsin-Chu (TW)

(73) Assignee: AU OPTRONICS CORPORATION, Hsin-Chu (TW)

( * ) Notice: Subject to any disclaimer, the term of this patent is extended or adjusted under 35 U.S.C. 154(b) by 0 days.

(21) Appl. No.: 16/658,650

(22) Filed: Oct. 21, 2019

(65) Prior Publication Data

US 2020/0394948 A1 Dec. 17, 2020

(30) Foreign Application Priority Data

Jun. 14, 2019 (TW) ..... 108120785

(51) Int. Cl.
*G09G 3/20* (2006.01)
*G09G 3/3233* (2016.01)

(52) U.S. Cl.
CPC ..... *G09G 3/2018* (2013.01); *G09G 3/3233* (2013.01); *G09G 2300/0809* (2013.01)

(58) Field of Classification Search
CPC ..... G09G 3/2018; G09G 3/3233
USPC ..... 345/690, 691
See application file for complete search history.

(56) References Cited

U.S. PATENT DOCUMENTS

| | | | | |
|---|---|---|---|---|
| 9,818,341 | B2 * | 11/2017 | Kwon | G09G 3/3291 |
| 2005/0057580 | A1 | 3/2005 | Yamano et al. | |
| 2005/0104875 | A1 | 5/2005 | Kwak et al. | |
| 2008/0111777 | A1 | 5/2008 | Kim | |
| 2009/0066617 | A1 | 3/2009 | Chang et al. | |
| 2012/0147000 | A1 | 6/2012 | Song et al. | |

(Continued)

FOREIGN PATENT DOCUMENTS

| | | | |
|---|---|---|---|
| CN | 101872581 | A | 10/2010 |
| CN | 103489404 | A | 1/2014 |
| CN | 105575335 | A | 5/2016 |

(Continued)

*Primary Examiner* — Calvin C Ma
(74) *Attorney, Agent, or Firm* — WPAT, PC

(57) ABSTRACT

A pixel circuit includes a driving circuit, a lighting element, and multiple switching circuits. The driving circuit is configured to provide a driving current to a first node. A first terminal of the lighting element is coupled with a second node. A second terminal of the lighting element is configured to receive a system low voltage. The multiple switching circuits are coupled between the first node and the second node in a parallel connection, and configured to correspondingly receive multiple emission control signals and at least one grayscale control signal. During each frame, the multiple emission control signals provide multiple pulses, and the multiple pulses do not mutually overlapping in time sequence, so that the multiple switching circuits selectively couple the first node to the second node according to the multiple pulses and the at least one grayscale control signal.

21 Claims, 15 Drawing Sheets

(56) References Cited

U.S. PATENT DOCUMENTS

2015/0379928 A1 12/2015 Zhang
2020/0074929 A1* 3/2020 Chen ..... G09G 3/3258

FOREIGN PATENT DOCUMENTS

CN 107452336 A 12/2017
CN 108717841 A 10/2018

* cited by examiner

PIXEL CIRCUIT, PIXEL CIRCUIT DRIVING METHOD, AND DISPLAY DEVICE THEREOF

CROSS-REFERENCE TO RELATED APPLICATION

This application claims priority to Taiwan Application Serial Number 108120785, filed Jun. 14, 2019, which is herein incorporated by reference in its entirety.

BACKGROUND

Field of Invention

The present disclosure generally relates to a pixel circuit, a pixel circuit driving method, and a display device thereof. More particularly, the present disclosure relates to a pixel circuit having a plurality of switching circuits.

Description of Related Art

Source drivers are widely used in a variety of displays to provide data voltages, so as to control the grayscale of pixels. However, the source driver includes a variety of circuits such as the digital to analog converter (DAC), the buffer, the level shifter, and the latch, which makes the source driver have complex structure and require a certain amount of layout space. Therefore, the source driver is not suitable for the use in an electronic device that is small in size and has a simple display function.

SUMMARY

The disclosure provides a pixel circuit including a driving circuit, a lighting element, and multiple switching circuits. The driving circuit is configured to provide a driving current to a first node. The lighting element includes a first terminal and a second terminal. The first terminal of the lighting element is coupled with a second node, and the second terminal of the lighting element is configured to receive a system low voltage. The multiple switching circuits are coupled between the first node and the second node in a parallel connection, and configured to correspondingly receive multiple emission control signals and at least one grayscale control signal. During each frame, the multiple emission control signals provide multiple pulses, and the multiple pulses do not mutually overlapping in time sequence, so that the multiple switching circuits selectively couple the first node to the second node according to the multiple pulses and the at least one grayscale control signal.

The disclosure provides a pixel circuit driving method suitable for a pixel circuit. The pixel circuit includes a driving circuit, a lighting element, and multiple switching circuits. The driving circuit is configured to provide a driving current to a first node. The lighting element includes a first terminal and a second terminal. The first terminal of the lighting element is coupled with a second node, and the second terminal of the lighting element is configured to receive a system low voltage. The multiple switching circuits are coupled between the first node and the second node in a parallel connection. The pixel circuit driving method includes the following operations: providing the pixel circuit; providing at least one grayscale control signal to the multiple switching circuits; correspondingly providing multiple emission control signals to the multiple switching circuits; and during each frame, utilizing the multiple emission control signals to provide multiple pulses. The multiple pulses do not mutually overlap in time sequence, so that the multiple switching circuits selectively couple the first node to the second node according to the multiple pulses and the at least one grayscale control signal.

The disclosure provides a display device including multiple pixel circuits and a control circuit. The multiple pixel circuits are arranged as n rows while n is an integer larger than 1. Each of the multiple pixel circuits includes a driving circuit, a lighting element, and multiple switching circuits. The driving circuit is configured to provide a driving current to a first node. The lighting element includes a first terminal and a second terminal. The first terminal of the lighting element is coupled with a second node, and the second terminal of the lighting element is configured to receive a system low voltage. The multiple switching circuits are coupled between the first node and the second node in a parallel connection, and are configured to correspondingly receive multiple emission control signals and at least one grayscale control signal. The control circuit is configured to provide the multiple emission control signals and the at least one grayscale control signal. During each frame, the multiple emission control signals provide multiple pulses, and the multiple pulses do not mutually overlapping in time sequence, so that the multiple switching circuits selectively couple the first node to the second node according to the multiple emission control signals and the at least one grayscale control signal.

It is to be understood that both the foregoing general description and the following detailed description are by examples, and are intended to provide further explanation of the disclosure as claimed.

DETAILED DESCRIPTION

Figure 1:
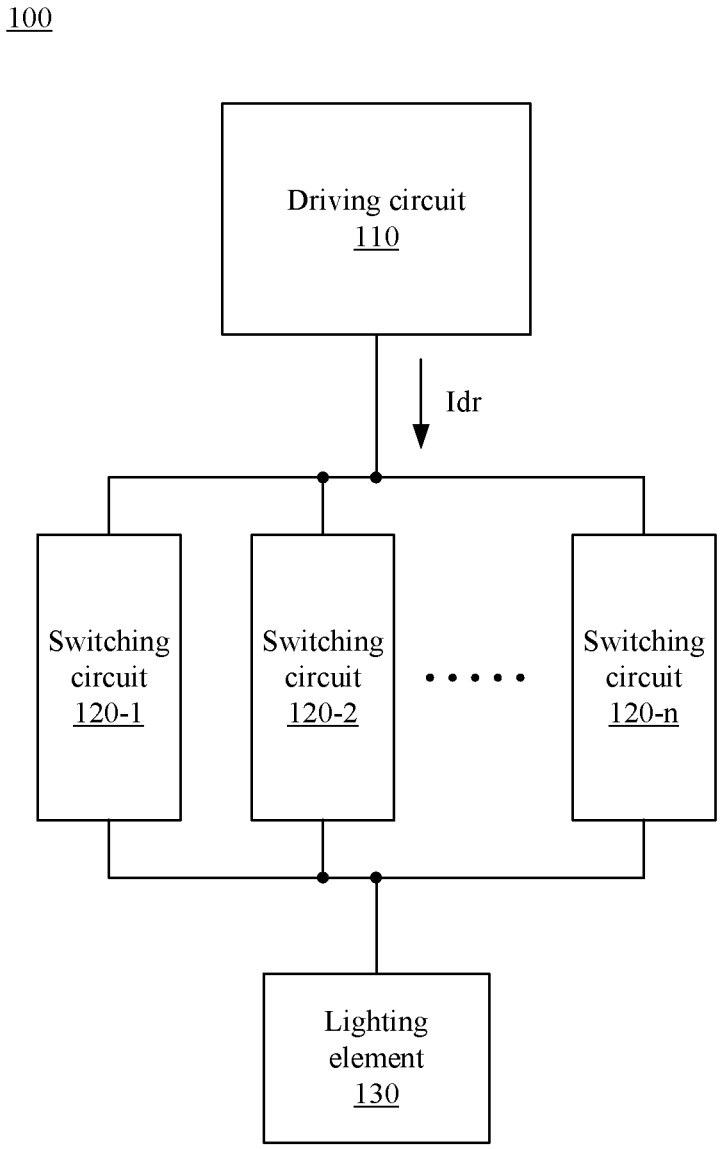
FIG. 1 is a simplified functional block diagram of a pixel circuit according to one embodiment of the present disclosure.

Reference will now be made in detail to the present embodiments of the disclosure, examples of which are illustrated in the accompanying drawings. Wherever possible, the same reference numbers are used in the drawings and the description to refer to the same or like parts.

FIG. 1 is a simplified functional block diagram of a pixel circuit 100 according to one embodiment of the present disclosure. The pixel circuit 100 comprises a driving circuit 110 configured to provide a driving current Idr, a plurality of switching circuits 120-1~**120-*n*, and a lighting element 130. The switching circuits 120-1~120-*n* are coupled between the driving circuit 110 and the lighting element 130 in a parallel connection. Each of the switching circuits 120-1~120-*n* may be independently set at a conducting status or at a switched-off status, and the switching circuits 120-1~120-*n*** may be conducted for different time lengths.

In each frame, one or more of the switching circuits 120-1~**120-*n* at the conducting status are sequentially conducted, and would not be conducted synchronously. Therefore, the driving current Idr is transmitted to the lighting element 130 through the one or more of the switching circuits 120-1~120-*n* at the conducting status, so as to control the emission time of the lighting element 130. By sequentially and selectively conducting the switching circuits 120-1~120-*n* during one frame, the pixel circuit 100** is capable of providing 2n different grayscales to the user by using the driving current Idr having the same magnitude, and n is an integer.

For the convenience of explanation, the conducting times of the switching circuits 120-1~**120-*n* of this embodiment are set as positively correlated to the indexes of the reference labels. For example, the switching circuit 120-1 has the shortest conducting time, and the switching circuit 120-*n* has the longest conducting time, but this disclosure is not limited thereto. The relationship between the arrangement order of the switching circuits 120-1~120-*n* and the conducting times is merely an exemplary embodiment. In practice, various conducting times may also be randomly assigned to the switching circuits 120-1~120-*n***. In the following descriptions, the smallest to the largest grayscales are presented as 0-th to (2n−1)-th grayscales, respectively.

In an embodiment that n equals 3, the smallest and the largest grayscales are the 0-th and the 7-th grayscales, respectively. When the pixel circuit 100 provides the 0-th grayscale, the switching circuits 120-1~120-3 are set as (0, 0, 0) to prevent the driving current Idr to flow to the lighting element 130. The multiple fields in the parentheses represent the operating status of the switching circuits 120-1~120-3, respectively, from left to right, and 0 is the switched-off status and 1 is the conducting status. The operation status of the switching circuits 120-1~120-3 are set as (1, 0, 0), (0, 1, 0), (1, 1, 0), (0, 0, 1), (1, 0, 1), (0, 1, 1), and (1, 1, 1) to provide the 1-th through 7-th grayscales, respectively. As aforementioned, the one or more of the switching circuits 120-1~120-3 at the conducting status are conducted in sequence. Therefore, take the 7-th grayscale as an example, when the operation status of the switching circuits 120-1~120-3 is set as (1, 1, 1), the driving current Idr flows to the lighting element 130 via the switching circuits 120-1~120-3 in sequence, so that the emission time of the lighting element 130 is equal to the sum of the conducting times of the switching circuits 120-1~120-3 to render the lighting element 130 has the longest emission time.

Figure 2:
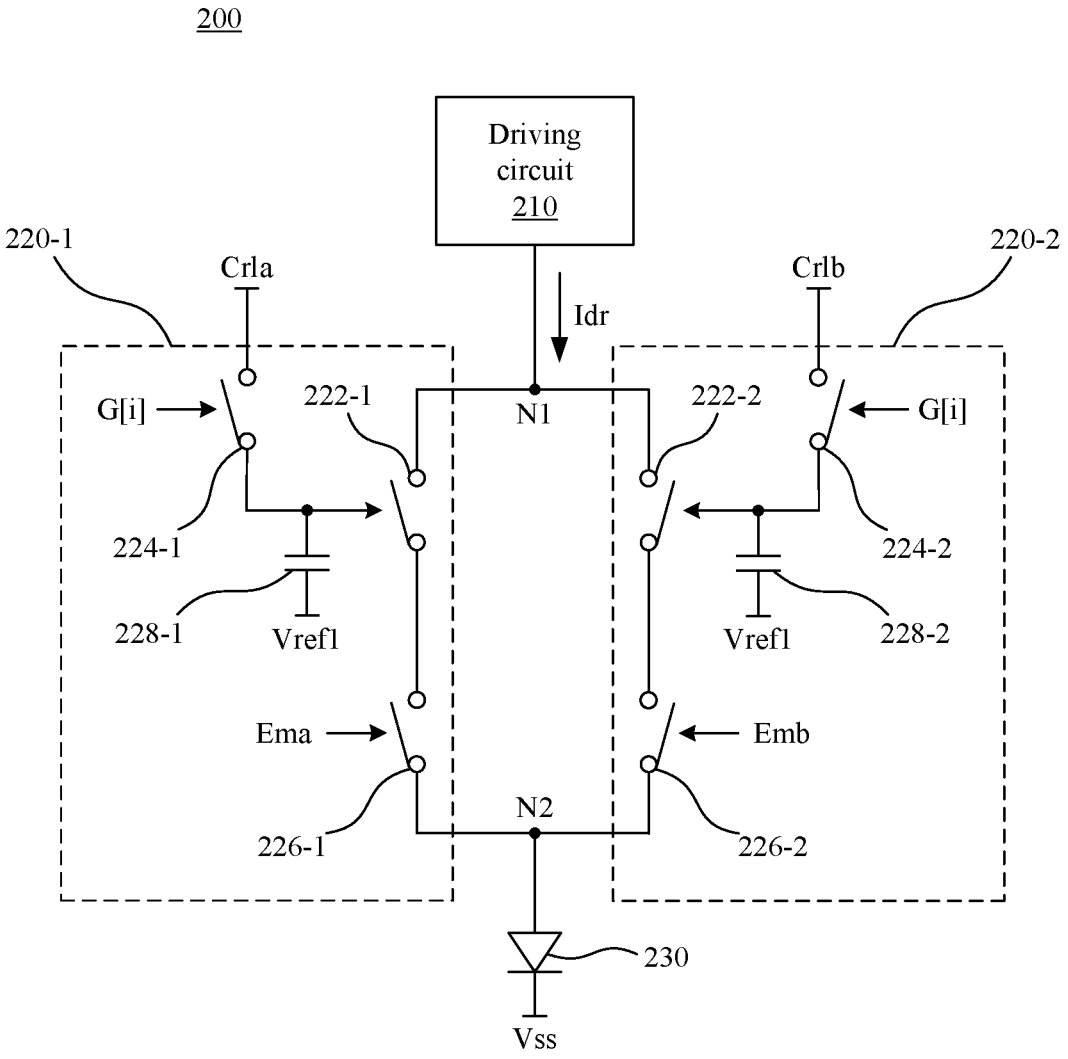
FIG. 2 is a functional block diagram of a pixel circuit according to one embodiment of the present disclosure.

FIG. 2 is a functional block diagram of a pixel circuit 200 according to one embodiment of the present disclosure. The pixel circuit 100 of FIG. 1 may be realized by the pixel circuit 200. The pixel circuit 200 comprises a driving circuit 210, a plurality of switching circuits 220-1~220-2, and lighting element 230. The driving circuit 210 is configured to provide the driving current Idr to a first node N1. A first terminal of the lighting element 230 is coupled with a second node N2, and a second terminal of the lighting element 230 is configured to receive a system low voltage VSS. The switching circuits 220-1~220-2 are coupled between the first node N1 and the second node N2 in a parallel connection.

The switching circuit 220-1 comprises a first switch 222-1, a second switch 224-1, a third switch 226-1, and a storage capacitor 228-1. A first terminal of the first switch 222-1 is coupled with the first node N1. A first terminal of the second switch 224-1 is configured to receive a grayscale control signal Crla, and a second terminal of the second switch 224-1 is coupled with a control terminal of the first switch 222-1. A control terminal of the second switch 224-1 is configured to receive a writing control signal G[i]. A first terminal of the third switch 226-1 is coupled with a second terminal of the first switch 222-1. A second terminal of the third switch 226-1 is coupled with the second node N2. A control terminal of the third switch 226-1 is configured to receive an emission control signal Ema. A first terminal of the storage capacitor 228-1 is coupled with the control terminal of the first switch 222-1, and A second terminal of the storage capacitor 228-1 is configured to receive a first reference voltage Vref1.

The switching circuit 220-2 is similar to the switching circuit 220-1, one difference is that a first terminal of the second switch 224-2 of the switching circuit 220-2 is configured to receive a grayscale control signal Crlb; other difference is that a control terminal of the third switch 226-2 of the switching circuit 220-2 is configured to receive an emission control signal Emb. The grayscale control signal Crla is different from the grayscale control signal Crlb, and the emission control signal Ema is different from the emission control signal Emb. The foregoing descriptions regarding the implementations, connections, operations, and related advantages of other corresponding components in the switching circuit 220-1 are also applicable to the switching circuit 220-2. For the sake of brevity, those descriptions will not be repeated here.

Figure 3:
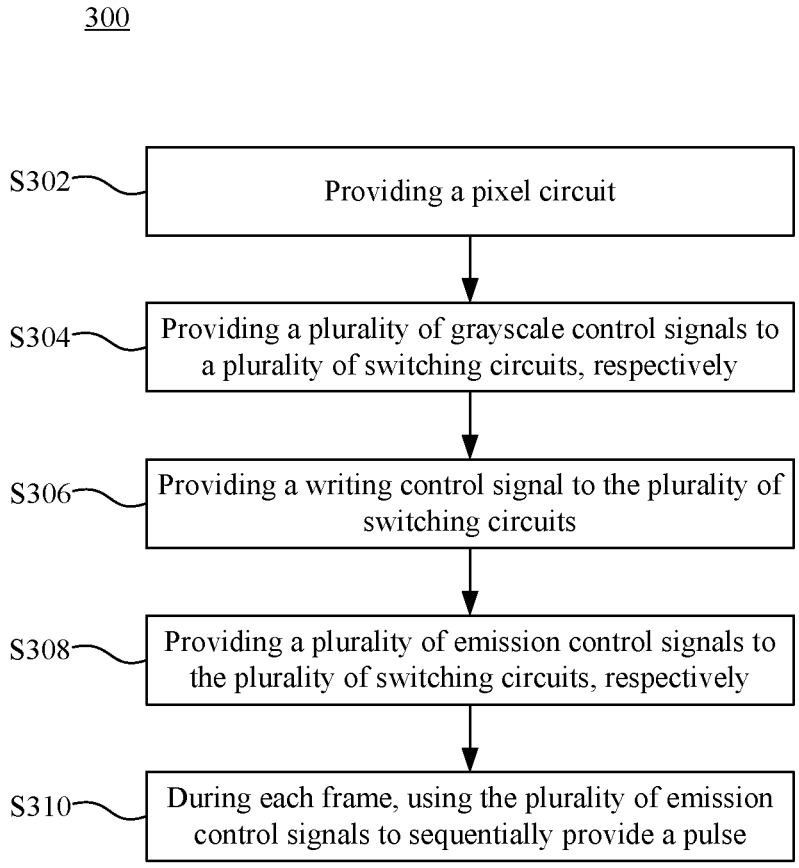
FIG. 3 is a flowchart of a pixel circuit driving method according to one embodiment of the present disclosure.
Figure 4:
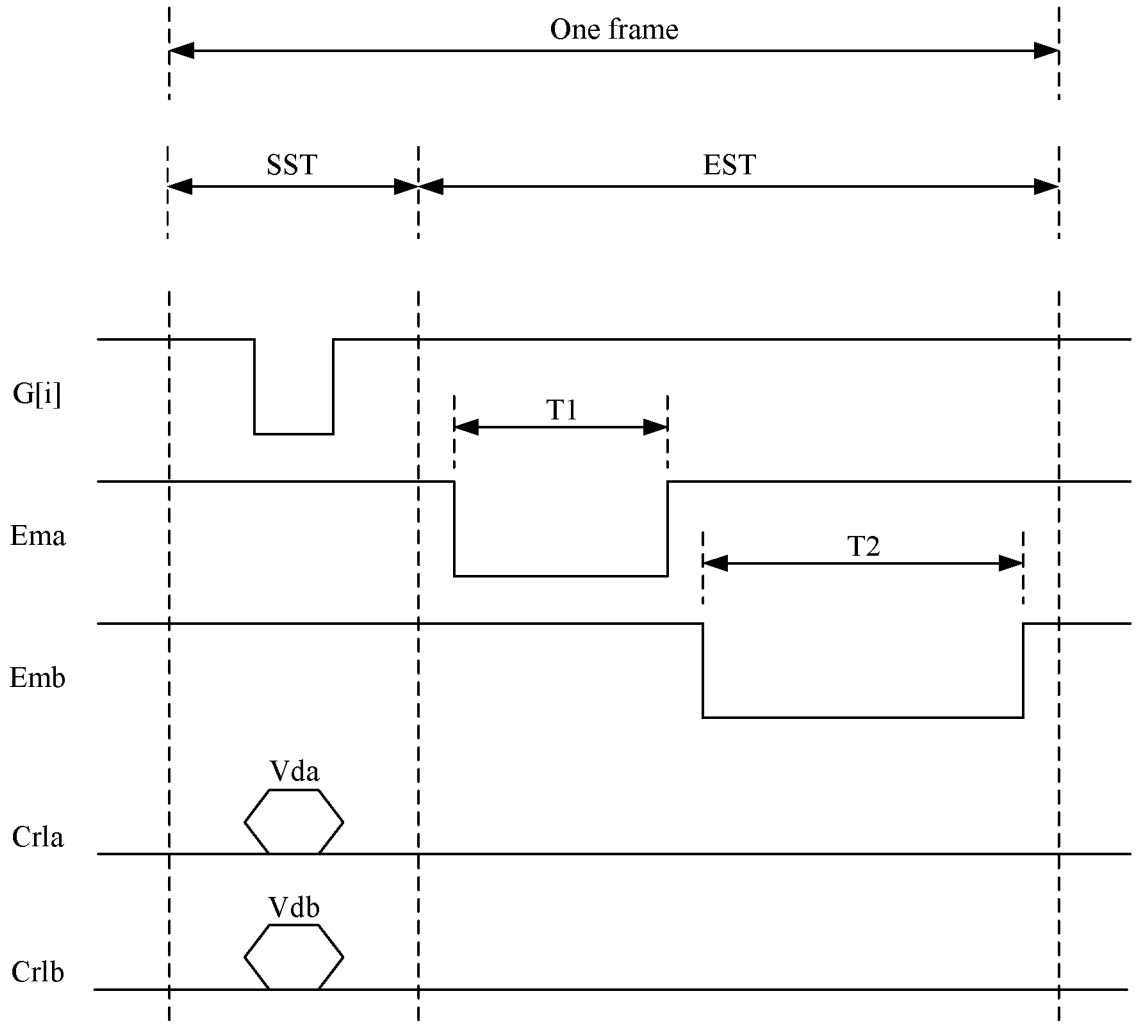
FIG. 4 is a simplified waveform schematic diagram of control signals provided to the pixel circuit of FIG. 2 according to one embodiment of the present disclosure.

FIG. 3 is a flowchart of a pixel circuit driving method 300 according to one embodiment of the present disclosure. FIG. 4 is a simplified waveform schematic diagram of a plurality of control signals provided to the pixel circuit 200 of FIG. 2 according to one embodiment of the present disclosure. The pixel circuit driving method 300 comprises operations S302~S310. In operation S302, the pixel circuit 200 of FIG. 2 is provided. In operation S304, the grayscale control signals Crla~Crlb are provided to the switching circuits 220-1~220-2, respectively. In operation S306, the writing control signal G[i] is provided to the switching circuit 220-1~220-2, so that the switching circuit 220-1 receives a data voltage Vda from the grayscale control signal Crla while the switching circuit 220-2 receives a data voltage Vdb from the grayscale control signal Crlb. In some embodiments, the switching circuits 220-1~220-2 receive the data voltages Vda~Vdb in parallel. In operation S308, the emission control signals Ema~Emb are provided to the switching circuits 220-1~220-2, respectively. In operation S310, the emission control signals Ema~Emb sequentially provide a pulse with a logic high level during each frame, and thus each of the switching circuits 220-1~220-2 selectively couples the first node N1 to the second node N2 according to a corresponding pulse and a corresponding data voltage. The pulses provided by the emission control signals Ema~Emb do not overlap with each other in time sequence.

Reference is made to FIGS. 2 through 4, the pixel circuit driving method 300 may be executed by a display device comprising a plurality of pixel circuits 200. The operation of the display device for one frame may be divided into a setup stage SST and an emission stage EST.

The display device conducts operations S302~S306 in the setup stage SST. During the setup stage SST, the writing control signal G[i] provides a pulse having the logic high level to the control terminals of the second switches 224-1~224-2, and thus the data voltages Vda~Vdb are transmitted to the storage capacitors 228-1~228-2, respectively. The data voltage Vda may have the logic high level or a logic low level to correspondingly conduct or switch off the first switch 222-1. Similarly, the data voltage Vdb may also have the logic high level or the logic low level to correspondingly conduct or switch off the first switch 222-2.

The display device conducts operations S302~S306 in the emission stage EST. During the emission stage EST, the emission control signals Ema~Emb sequentially provide one pulse having the logic high level to conduct the third switches 226-1~226-2. The two respective pulses of the emission control signals Ema~Emb do not overlap with each other in time sequence. The pulse width of the pulse provided by the emission control signal Ema is smaller than that of the pulse provided by the emission control signal Emb. In one embodiment, the pulse width of the emission control signal Emb is 2 to 3 times of that of the emission control signal Ema. If the first switch 222-1 and/or the first switch 222-2 are set at the conducting status during the setup stage SST, the driving current Idr flows to the lighting element 130 during the emission stage EST via a path comprising the first switch 222-1 and the third switch 226-1 and/or via another path comprising the first switch 222-2 and the third switch 226-2.

As can be appreciated from the foregoing descriptions, the pixel circuit 100 in an embodiment that n equals 2 is similar to the pixel circuit 200, and thus the pixel circuit 200 is capable of providing four different grayscales, i.e., the 0-th through the 3-rd grayscales. When the pixel circuit 200 is configured to provide the 0-th grayscale, the first switches 222-1~222-2 are both set at the switched-off status so that the lighting element 130 would not emit during the emission stage EST.

When the pixel circuit 200 is configured to provide the 1-st grayscale, the first switches 222-1~222-2 are set at the conducting status and the switched-off status, respectively. Therefore, the lighting element 130 emits during the first time period T1.

When the pixel circuit 200 is configured to provide the 2-nd grayscale, the first switches 222-1~222-2 are set at the switched-off status and the conducting status, respectively. Therefore, the lighting element 130 emits during the second time period T2, and the second time period T2 is longer than the first time period T1.

When the pixel circuit 200 is configured to provide the 3-rd grayscale, the first switches 222-1~222-2 are both set at the conducting status. Therefore, the lighting element 130 emits during the first time period T1 and the second time period T2.

In other words, the pixel circuit 200 needs not to use complex analog or digital signals generated by an additional source driver. The pixel circuit 200 is capable of providing various grayscales to the user based on the driving current Idr having the same magnitude, thereby helping to reduce the circuit layout area and to reduce the design difficulty.

Figure 5:
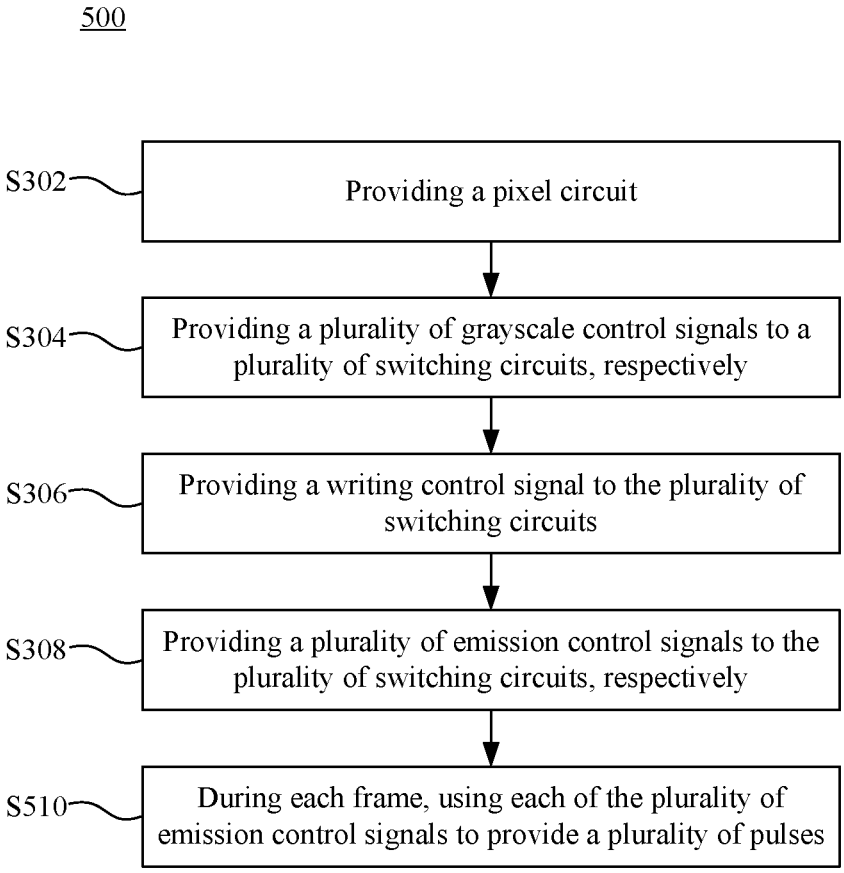
FIG. 5 is a flowchart of a pixel circuit driving method according to one embodiment of the present disclosure.
Figure 6:
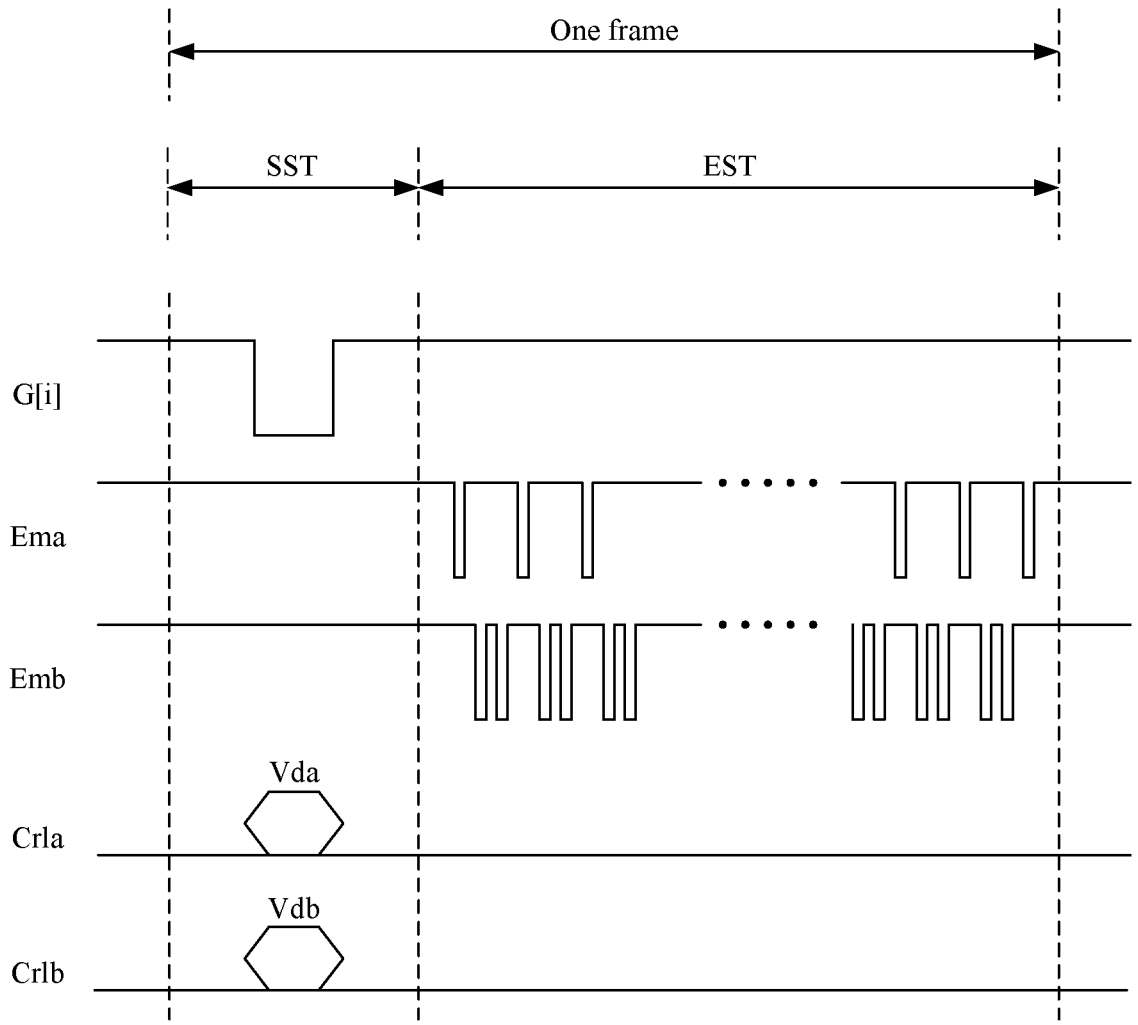
FIG. 6 is a simplified waveform schematic diagram of a plurality of control signals provided to the pixel circuit of FIG. 2 according to another embodiment of the present disclosure.

FIG. 5 is a flowchart of a pixel circuit driving method 500 according to one embodiment of the present disclosure. FIG. 6 is a simplified waveform schematic diagram of a plurality of control signals provided to the pixel circuit 200 of FIG. 2 according to another embodiment of the present disclosure. The pixel circuit driving method 500 is similar to the pixel circuit driving method 300, the difference is that, in operation S510 of the pixel circuit driving method 500, the display device uses each of the emission control signals Ema~Emb to provide a plurality of pulses having the logic high level during each frame. Therefore, the switching circuits 220-1~220-2 selectively couple the first node N1 to the second node N2 for multiple times.

As shown in FIG. 6, the pulses provided by the emission control signals Ema~Emb have the same pulse width and do not overlap with each other in time sequence. In addition, the frequency of the pulses of the emission control signal Emb is higher than that of the pulses of the emission control signal Ema. In one embodiment, the frequency of the pulses of the emission control signal Emb is 2 to 3 times of that of the emission control signal Ema. That is, the number of the pulses the emission control signal Emb has in each frame is 2 to 3 times of that of the pulses the emission control signal Ema has in each frame. Since the emitting time of the lighting element 130 is approximately evenly distributed in one frame, the pixel circuit driving method 500 helps to reduce the flicker of the picture.

In practice, the first switches 222-1~222-2, the second switches 224-1~224-2, and the third switches 226-1~226-2 of FIG. 2 may be realized by P-type transistors of any suitable category. For instance, the thin-film transistor (TFT), the Metal-Oxide-Semiconductor Field-Effect Transistor (MOSFET), and so forth. The lighting element 230 may be realized by the Micro LED or the organic light-emitting diode (OLED). In this situation, the logic high level is a low voltage level, and the logic low level is a high voltage level.

In another embodiment, the first switches 222-1~222-2, the second switches 224-1~224-2, and the third switches 226-1~226-2 may be realized by N-type transistors of any suitable category. In this situation, the logic high level is the high voltage level, and the logic low level is the low voltage level.

Figure 7:
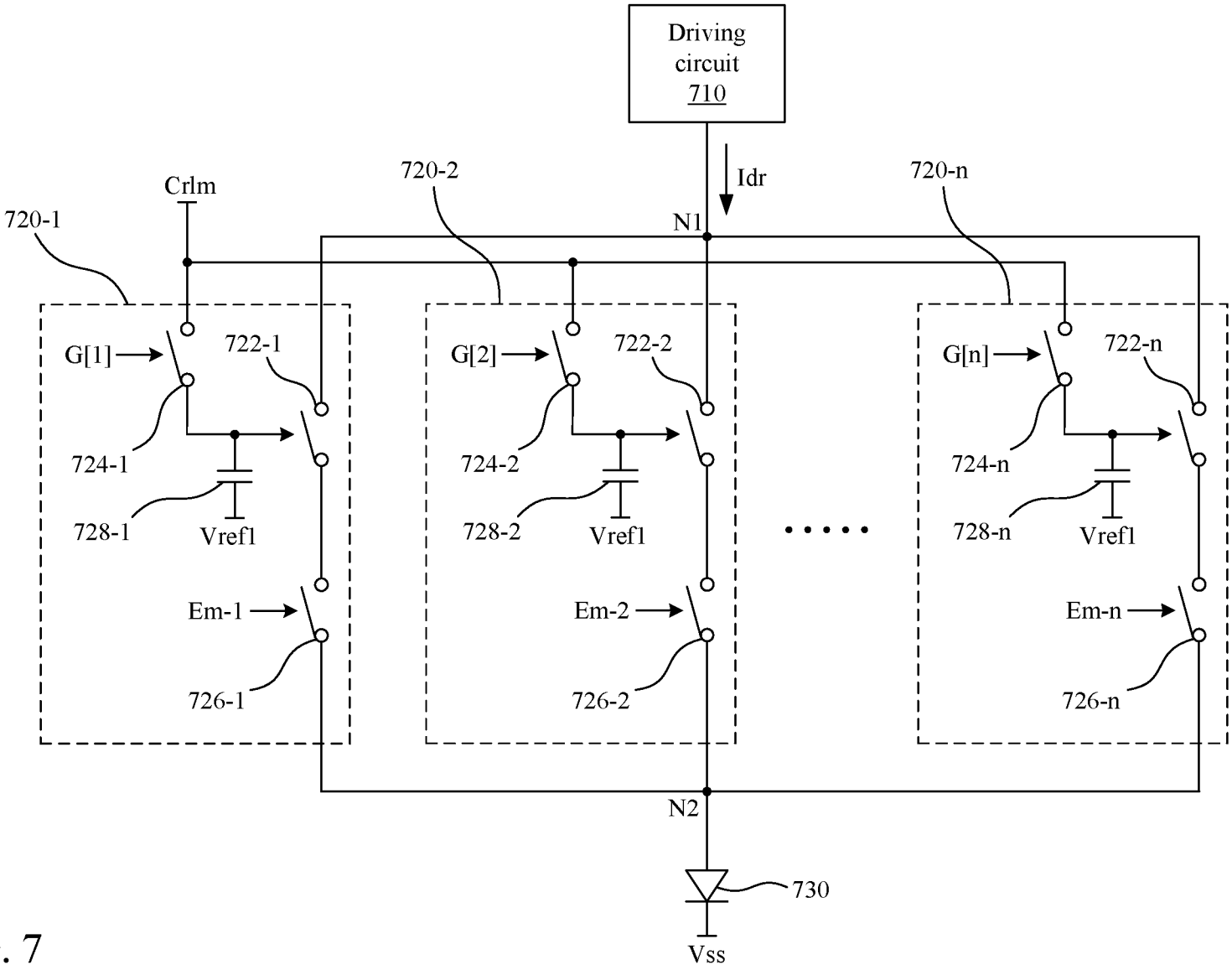
FIG. 7 is a functional block diagram of a pixel circuit according to one embodiment of the present disclosure.

FIG. 7 is a functional block diagram of a pixel circuit 700 according to one embodiment of the present disclosure. The pixel circuit 100 of FIG. 1 may be realized by the pixel circuit 700. The pixel circuit 700 comprises a driving circuit 710, a plurality of switching circuits **720-1~720-*n*, and a lighting element 730. The driving circuit 710 is configured to provide the driving current Idr to the first node N1. A first terminal of the lighting element 730 is coupled with the second node N2, and the second terminal of the lighting element 730 is configured to receive the system low voltage VSS. The switching circuits 720-1~720-*n* are coupled between the first node N1 and the second node N2** in a parallel connection.

The switching circuit 720-1 comprises a first switch 722-1, a second switch 724-1, a third switch 726-1, and a storage capacitor 728. A first terminal of the first switch 722-1 is coupled with the first node N1. A first terminal of the second switch 724-1 is configured to receive a grayscale control signal Crlm. A second terminal of the second switch 724-1 is coupled with a control terminal of the first switch 722-1. A control terminal of the second switch 724-1 is configured to receive a writing control signal G[1]. A first terminal of the third switch 726-1 is coupled with a second terminal of the first switch 722-1. A second terminal of the third switch 726-1 is coupled with the second node N2. A control terminal of the third switch 726-1 is configured to receive an emission control signal Em-1. A first terminal of the storage capacitor 728-1 is coupled with the control terminal of the first switch 722-1, and a second terminal of the storage capacitor 728-1 is configured to receive the first reference voltage Vref1.

Each of the switching circuits 720-2~720-*n* is similar to the switching circuit 720-1, the difference is that the control terminals of the second switches 724-2~724-*n* of the switching circuits 720-2~720-*n* are configured to receive writing control signals G[2]~G[n], respectively; other difference is that the control terminals of the third switches 726-2~726-*n* of the switching circuits 720-2~720-*n* are configured to receive emission control signals Em-2~Em-n, respectively. The foregoing descriptions regarding the implementations, connections, operations, and related advantages of other corresponding components in the switching circuit 720-1 are also applicable to the switching circuits 720-2~720-*n*. For the sake of brevity, those descriptions will not be repeated here.

Figure 8:
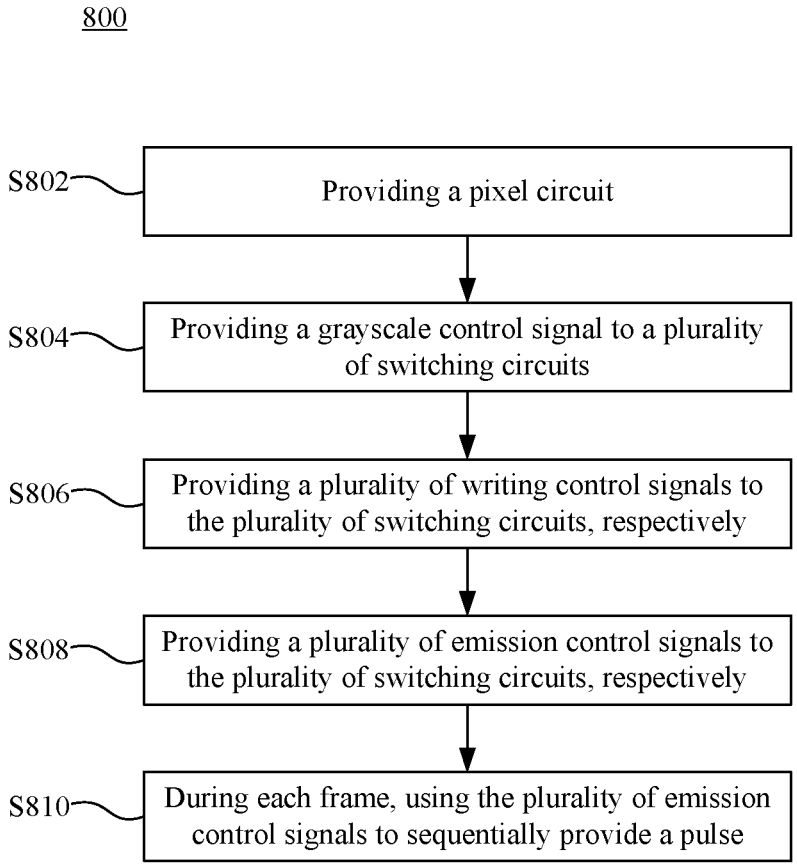
FIG. 8 is a flowchart of a pixel circuit driving method according to one embodiment of the present disclosure.
Figure 9:
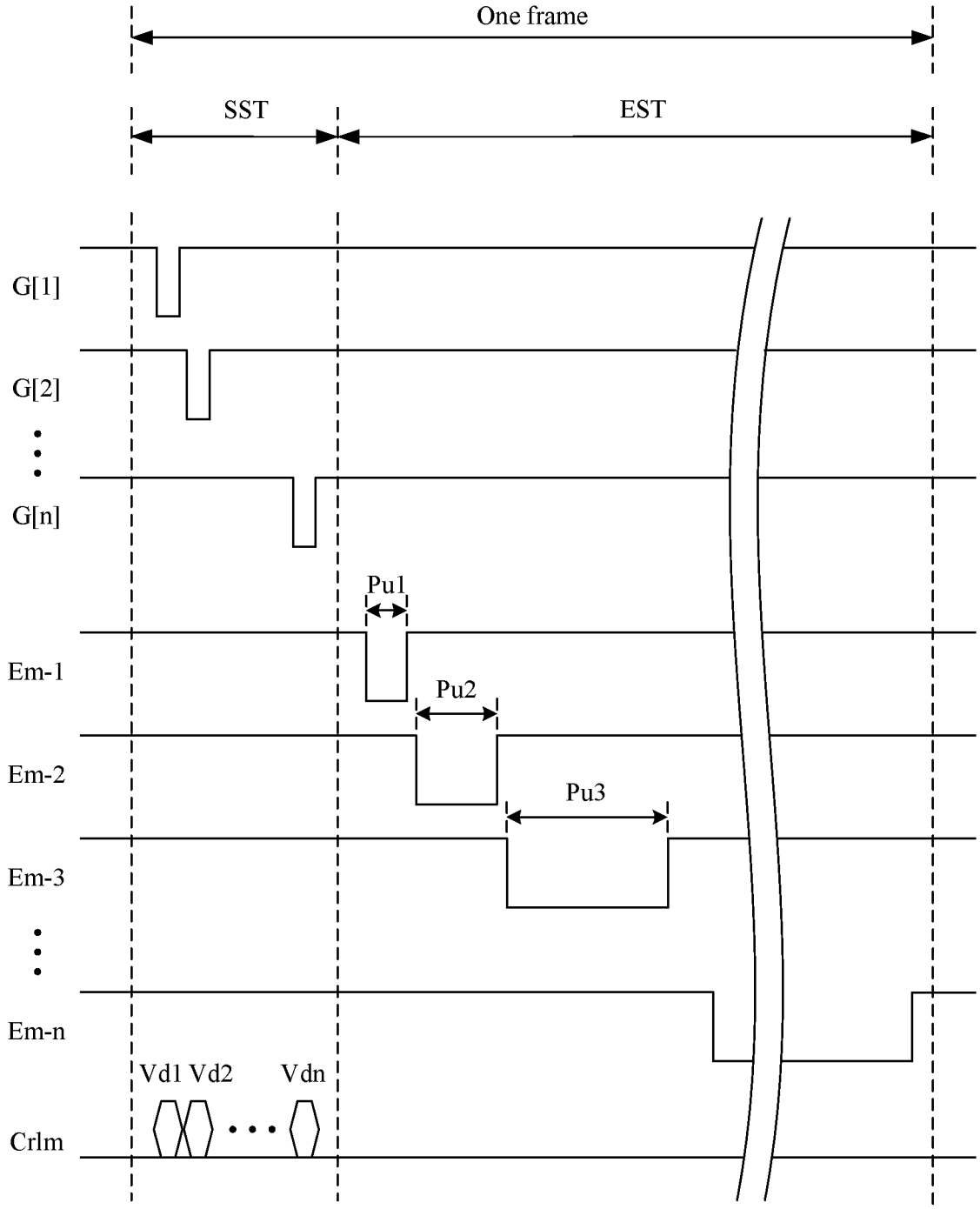
FIG. 9 is a simplified waveform schematic diagram of a plurality of control signals provided to the pixel circuit of FIG. 7 according to one embodiment of the present disclosure.

FIG. 8 is a flowchart of a pixel circuit driving method 800 according to one embodiment of the present disclosure. FIG. 9 is a simplified waveform schematic diagram of a plurality of control signals provided to the pixel circuit 700 of FIG. 7 according to one embodiment of the present disclosure. The pixel circuit driving method 800 comprises operations S802~S810. In operation S802, the pixel circuit 700 of FIG. 7 is provided. In operation S804, the grayscale control signal Crlm is provided to the switching circuits 720-1~720-*n*. In operation S806, the writing control signals G[1]~G[n] are provided to the switching circuits 720-1~720-*n*, respectively, thereby the switching circuits 720-1~720-*n* receive the grayscale control signal Crlm in sequence. In operation S808, the emission control signals Em-1~Em-n are provided to the switching circuits 720-1~720-*n*, respectively. In operation S810, the emission control signals Em-1~Em-n sequentially provide a pulse in each frame, so that the switching circuits 720-1~720-*n* selectively couple the first node N1 to the second node N2. The pulses provided by the emission control signals Em-1~Em-n do not overlap with each other in time sequence.

Reference is made to FIGS. 7 through 9, the pixel circuit driving method 800 may be executed by a display device comprising a plurality of pixel circuits 700. The operation of the display device for one frame may be divided into the setup stage SST and the emission stage EST.

The display device conducts operations S802~S806 in the setup stage SST. During the setup stage SST, the writing control signals G[1]~G[n] sequentially provide a pulse having the logic high level to the control terminals of the second switches 724-1~724-*n*, so that a plurality of data voltages Vd1~-Vdn are transmitted to the storage capacitors 728-1~728-*n* via the grayscale control signal Crlm. Each of the data voltages Vd1~Vdn has the logic high level or the logic low level, so as to correspondingly conduct or switch off the first switches 722-1~722-*n*.

The display device conducts operation S802-S806 in the emission stage EST. During the emission stage EST, the emission control signals Em-1~Em-n sequentially provide a pulse having the logic high level to conduct the third switches 726-1~726-*n* in sequence. The pulses provided by the emission control signals Em-1~Em-n do not overlapped with each other in time sequence. Two pulses adjacent to each other in time sequence have pulse widths having a ratio of 1:2 or of 2:1. For example, the pulse of the emission control signal Em-1 is the one before the pulse of the emission control signal Em-2 chronologically, and thus the pulse width Pu2 of the emission control signal Em-2 is 2 times of the pulse width Pu1 of the emission control signal Em-1. As another example, the pulse of the emission control signal Em-3 is the one after the pulse of the emission control signal Em-2 chronologically, and thus the pulse width Pu2 of the emission control signal Em-2 is 0.5 times of the pulse width Pu3 of the emission control signal Em-3. If the one or more of the first switches 722-1~722-*n* are set at the conducting status during the setup status SST, the driving current Idr flows to the lighting element 130 during the emission stage EST via the conducted one or more of the first switches 722-1~722-*n* and the corresponding one or more of the third switches 726-1~726-*n*.

For example, when the pixel circuit 700 is configured to provide the 0-th grayscale, the first switches 722-1~722-*n* are set at the switched-off status. Therefore, the lighting element 130 would not emit in the emission stage EST.

As another example, when the pixel circuit 200 is configured to provide the 1-st grayscale, the first switch 722-1 is set at the conducting status while the first switches 722-2~722-*n* are set at the switched-off status. Therefore, the lighting element 130 emits in the first time period T1.

As another example, when the pixel circuit 200 is configured to provide the 2-nd grayscale, the first switch 722-2 is set at the conducting status while the first switches 722-1 and 722-3~722-*n* are set at the switched-off status. Therefore, the lighting element 130 emits in the second period T2.

As yet another example, when the pixel circuit 200 is configured to provide the 3-rd grayscale, the first switches 722-1~722-2 are set at the conducting status while the first switches 722-3~722-*n* are set at the switched-off status. Therefore, the lighting element 130 emits in the first time period T1 and the second time period T2, and so forth.

As can be appreciated from the forgoing descriptions, the pixel circuit 700 needs not to use complex analog or digital signals generated by an additional source driver. The pixel circuit 700 is capable of providing 2n different grayscales to the user based on the driving current Idr having the same magnitude, thereby helping to reduce the circuit layout area and to reduce the design difficulty.

Figure 10:
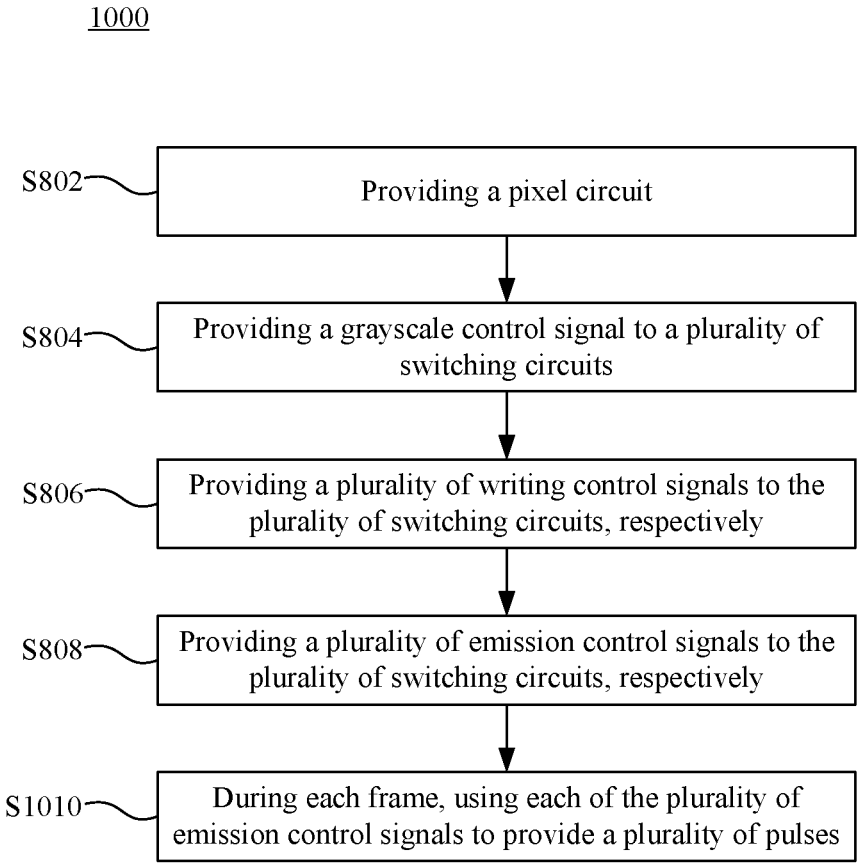
FIG. 10 is a flowchart of a pixel circuit driving method according to one embodiment of the present disclosure.
Figure 11:
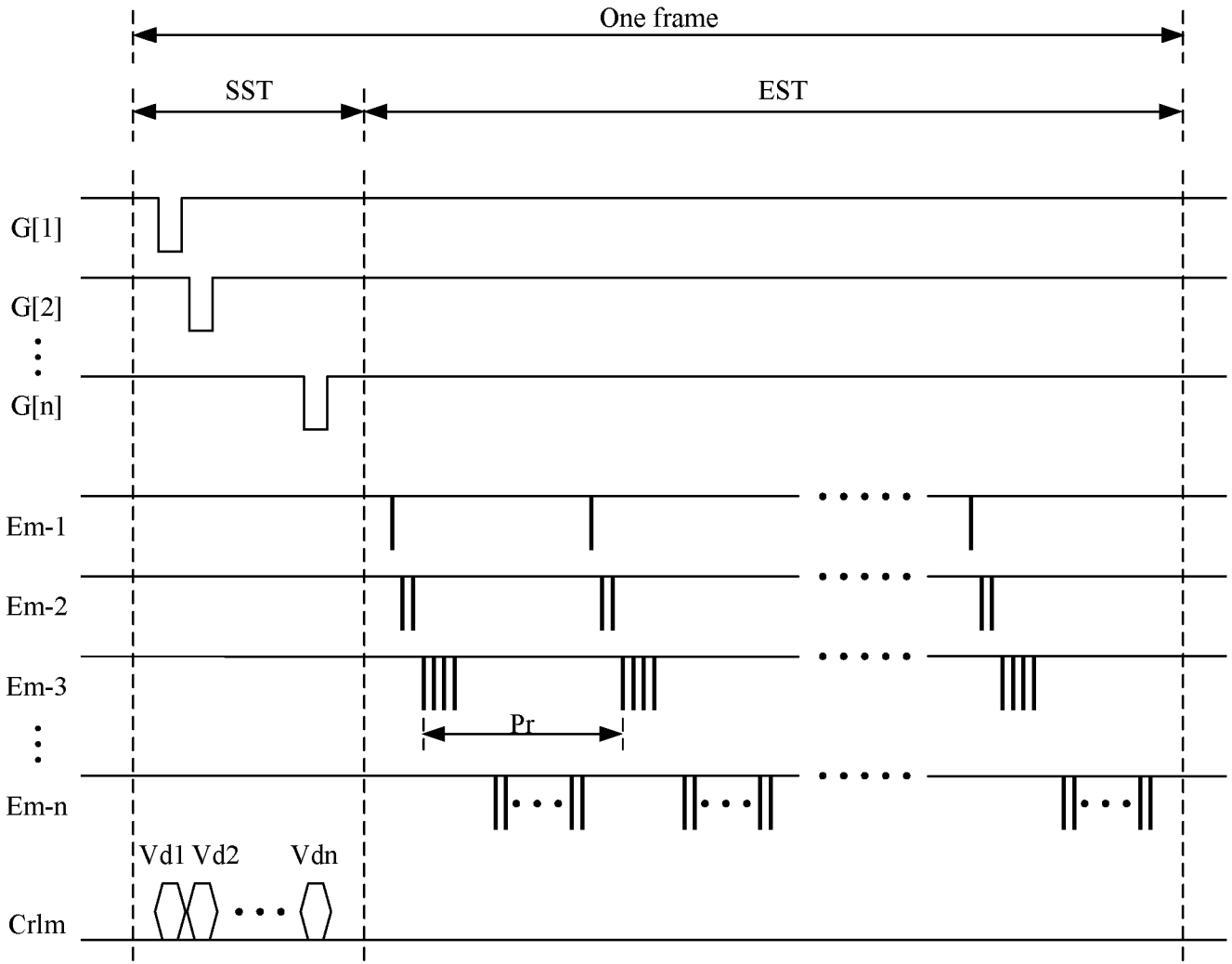
FIG. 11 is a simplified waveform schematic diagram of a plurality of control signals provided to the pixel circuit of FIG. 7 according to another embodiment of the present disclosure.

FIG. 10 is a flowchart of a pixel circuit driving method 1000 according to one embodiment of the present disclosure. FIG. 11 is a simplified waveform schematic diagram of a plurality of control signals provided to the pixel circuit 700 of FIG. 7 according to another embodiment of the present disclosure. The pixel circuit driving method 1000 is similar to the pixel circuit driving method 800, the difference is that, in operation S1010 of the pixel circuit driving method 1000, the display device uses each of the emission control signals Em-1~Em-n to provide a plurality of pulses having the logic high level during each frame. Therefore, the switching circuits 720-1~720-*n* selectively couple the first node N1 to the second node N2 for multiple times.

As shown in FIG. 11, the pulses provided by the emission control signals Em-1~Em-n have the same pulse width and do not overlap with each other in time sequence. During one frame, the emission control signals Em-1~Em-n sequentially start to provide the pulses. The later the time when one of the emission control signals Em-1~Em-n starts to provide the pulses, the more the pulses the one of the emission control signals Em-1~Em-n would provide. For example, the emission control signal Em-1 provides the pulses at the earliest and has the least pulses, while the emission control signal Em-n provides the pulses at the latest and has the most pulses. In addition, the number of pulses of one of the emission control signals Em-1~Em-n is 0.5 times of that of the chronologically later one of the emission control signals Em-1~Em-n; the number of pulses of the one of the emission control signals Em-1~Em-n is 2 times of that of the chronologically former one of the emission control signals Em-1~Em-n. For example, the pulse number of the emission control signal Em-2 is 2 times of that of the emission control signal Em-1, and is 0.5 times of that of the emission control signal Em-3.

In addition, the pulses of each of the emission control signals Em-1~Em-n are divided into a plurality of pulse groups in a number average manner. Each of the emission control signals Em-1~Em-n provides a corresponding one of the pulse groups thereof in a predetermined period. For example, in the emission stage EST, the emission control signal Em-3 provides a pulse group comprising four pulses in a period Pr.

Since the emitting time of the lighting element 730 is approximately evenly distributed in one frame, the pixel circuit driving method 1000 helps to reduce the flicker of the picture.

In practice, the first switches 722-1~722-*n*, the second switches 724-1~724-*n*, and the third switches 726-1~726-*n* of FIG. 7 may be realized by P-type transistors of any suitable category. For instance, the thin-film transistor (TFT), the Metal-Oxide-Semiconductor Field-Effect Transistor (MOSFET), and so forth. The lighting element 730 may be realized by the Micro LED or the organic light-emitting diode (OLED). In this situation, the logic high level is a low voltage level, and the logic low level is a high voltage level.

In one embodiment, the first switches 722-1~722-*n*, the second switches 724-1~724-*n*, and the third switches 726-1~726-*n* may be realized by N-type transistors of any suitable category. In this situation, the logic high level is the high voltage level, and the logic low level is the low voltage level.

In another embodiment, the pixel circuit 700 not only configured to receive the grayscale control signal Crlm, but also configured to receive at least one additional grayscale control signal. Each of the multiple grayscale control signals sequentially writes the data voltages into the corresponding one or more of the switching circuits 720-1~720-*n*. The multiple grayscale control signals may provide the data voltages concurrently to reduce the time length of the setup time SST.

Figure 12:
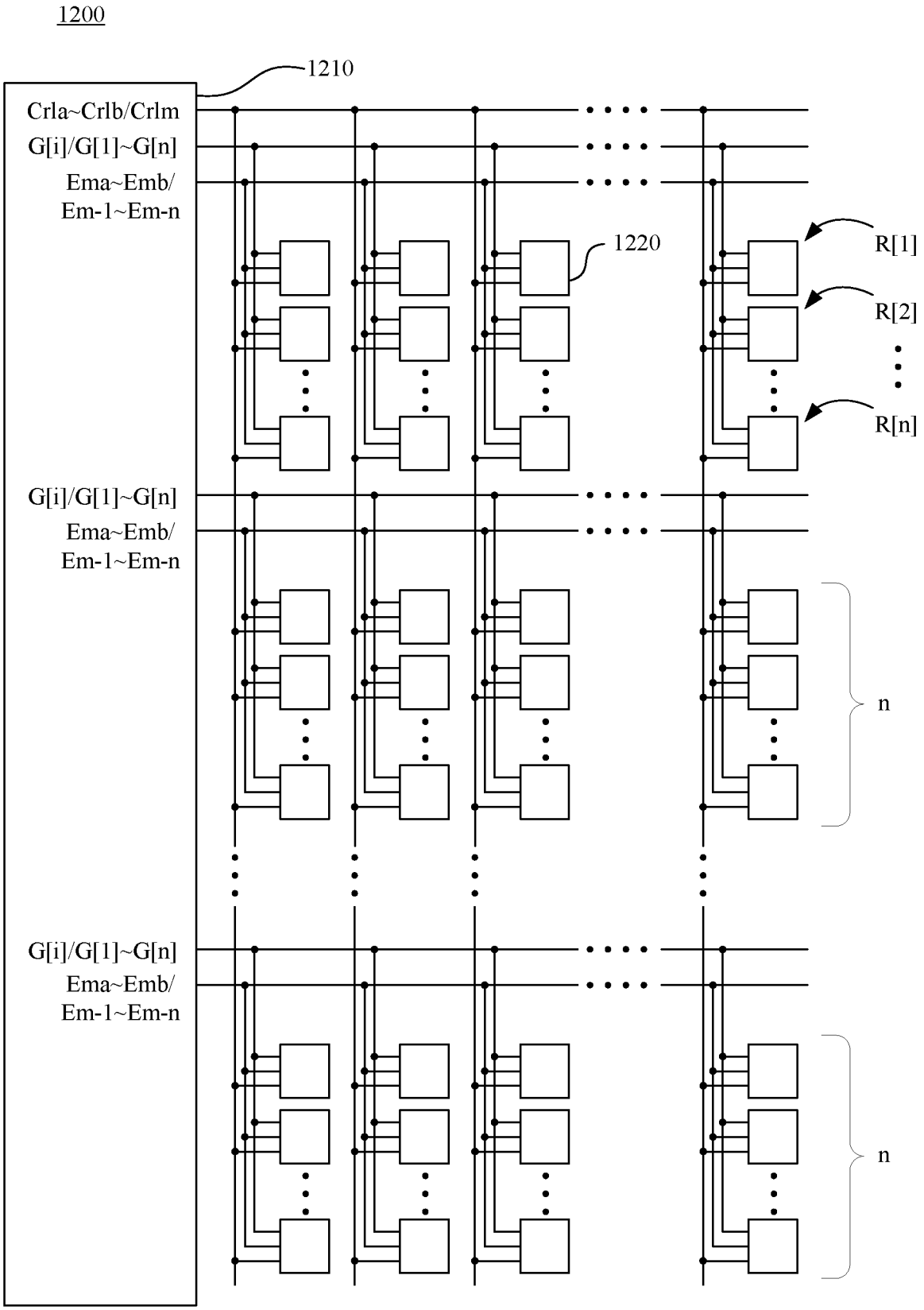
FIG. 12 is a simplified functional block diagram of a display device according to one embodiment of the present disclosure.

FIG. 12 is a simplified functional block diagram of a display device 1200 according to one embodiment of the present disclosure. The display device 1200 comprises a control circuit 1210 and a plurality of pixel circuits 1220. The pixel circuits 1220 may be realized by the pixel circuit 200 or 700 in the aforementioned embodiments. For the sake of brevity, other functional blocks of the display device 1200 are not shown in FIG. 11.

In an embodiment that the pixel circuit 1220 is realized by the pixel circuit 200, the control circuit 1210 provides the writing control signal G[i] and the emission control signals Ema~Emb to every n rows of pixel circuits 1220 (e.g., rows R[1]~R[n]) while n is an integer larger than 1. In addition, the control circuit 1110 provides the same grayscale control signals Crla~Crlb to every pixel circuits 1220.

In an embodiment that the pixel circuit 1220 is realized by the pixel circuit 700, the control circuit 1210 provides the writing control signals G[1]~G[n] and the emission control signals Em-1~Em-n to every n rows of pixel circuits 1220 while n is an integer larger than 1. In addition, the control circuit 1210 provides the same grayscale control signal Crlm to all of the pixel circuits 1220.

In other words, the writing control signal G[i], the writing control signals G[1]~G[n], the emission control signals Ema~Emb, and the emission control signals Em-1~Em-n of the aforementioned embodiments are signals being commonly used by every n rows of pixel circuits 1120. Therefore, the display device 1200 concurrently drives the switching circuits (i.e., the switching circuits 120-1~120-*n*, 220-1~220-*n*, or 720-1~720-*n*) of all of the pixel circuits 1220 in the n rows during the setup stage SST and the emission stage EST.

Figure 13:
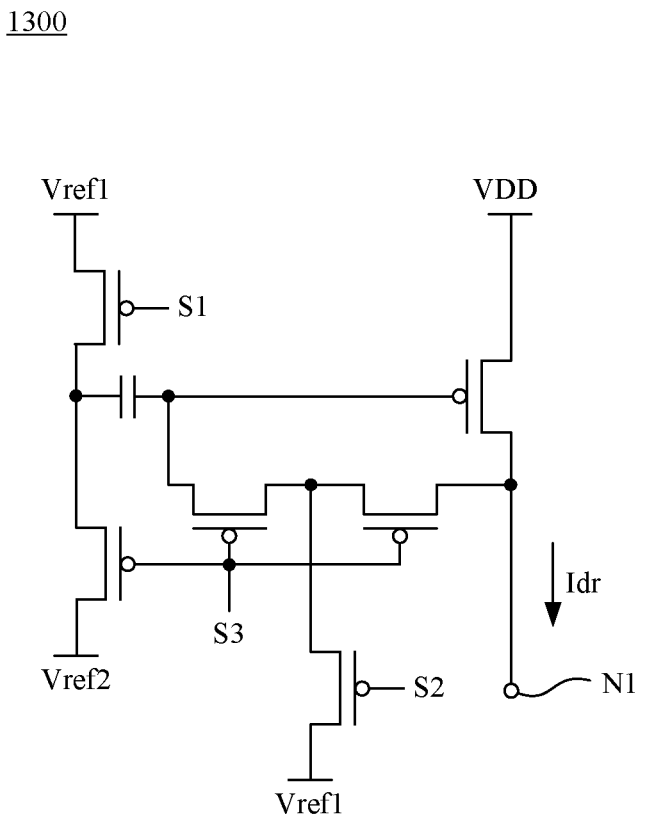
FIG. 13 is a circuit schematic diagram of a driving circuit according to one embodiment of the present disclosure.
Figure 14:
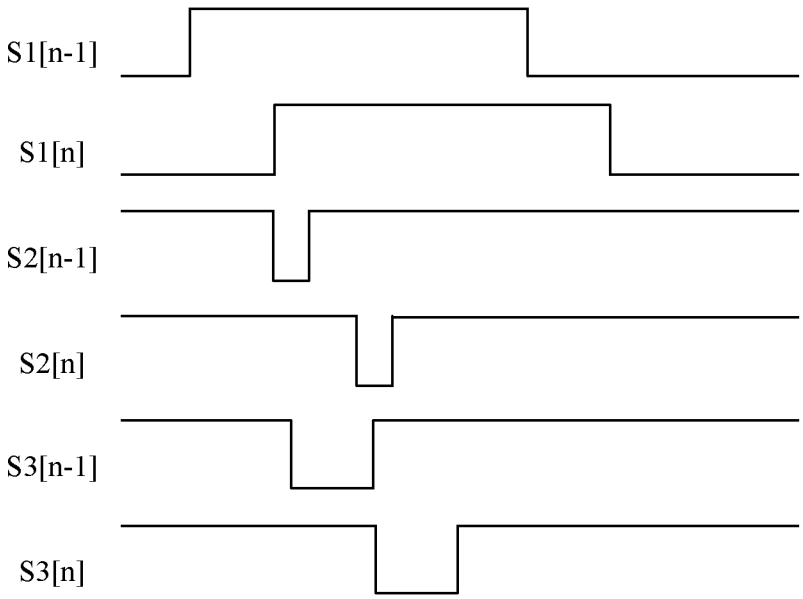
FIG. 14 is a simplified waveform schematic diagram of a plurality of control signals provided to the driving circuit of FIG. 13 according to one embodiment of the present disclosure.

In addition, in the setup stage SST, the control circuit 1210 setups the driving current Idr provided by the driving circuit (i.e., the driving circuit 110, 210, or 710) of each pixel circuit 1220 in a row by row manner. FIG. 13 is a circuit schematic diagram of a driving circuit 1300 according to one embodiment of the present disclosure. FIG. 14 is a simplified waveform schematic diagram of a plurality of control signals provided to the driving circuit 1300 of FIG. 13 according to one embodiment of the present disclosure. The driving circuit 1300 may be used to realize the driving circuits 110, 210, and 710 in the aforementioned embodiments. The driving circuit 1300 is operated according to the first control signal S1[*n*], the second control signal S2[*n*], the third control signal S3[*n*], the first reference voltage Vref1, the second reference voltage Vref2, and the system high voltage VDD. The first control signal S1[*n*−1], the second control signal S2[*n*−1], and the third control signal S3[*n*−1] of FIG. 14 are also provided to other driving circuits 1300 disposed in a previous row.

Figure 15:
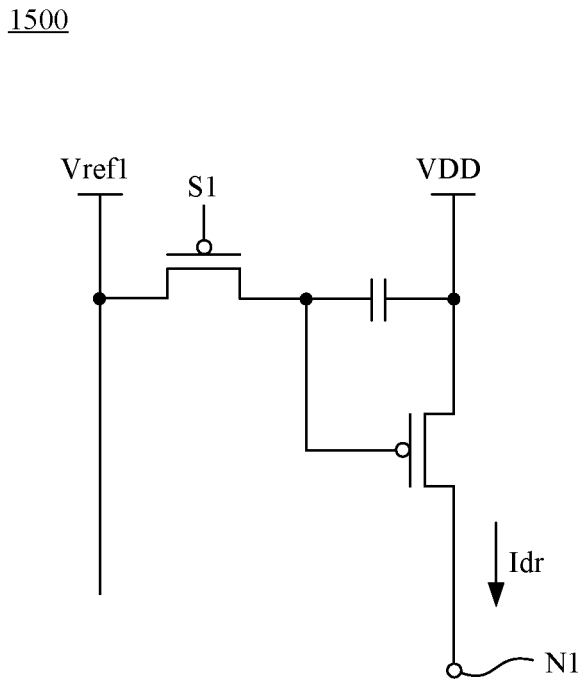
FIG. 15 is a circuit schematic diagram of a driving circuit according to another embodiment of the present disclosure.

In some embodiments that the variation in component characteristic needs not to be considered, the driving circuits 110, 210, and 710 may also be realized by the driving circuit 1500 shown in FIG. 15, or be realized by other suitable current source circuits. The driving circuit 1500 is operated only according to the first control signal S1, the first reference voltage Vref1, and the system high voltage VDD, thereby having an advantage of saving circuit layout area.

As can be appreciated from the foregoing descriptions, the pixel circuits and display devices in this disclosure are capable of providing various grayscales by using digital signals having simple waveforms. The pixel circuits and display devices in this disclosure needs not to cooperate with a source driver having complex structure, thereby can be designed easily and having small circuit layout area.

Certain terms are used throughout the description and the claims to refer to particular components. One skilled in the art appreciates that a component may be referred to as different names. This disclosure does not intend to distinguish between components that differ in name but not in function. In the description and in the claims, the term "comprise" is used in an open-ended fashion, and thus should be interpreted to mean "include, but not limited to." The term "couple" is intended to compass any indirect or direct connection. Accordingly, if this disclosure mentioned that a first device is coupled with a second device, it means that the first device may be directly or indirectly connected to the second device through electrical connections, wireless communications, optical communications, or other signal connections with/without other intermediate devices or connection means.

The term "and/or" may comprise any and all combinations of one or more of the associated listed items. In addition, the singular forms "a," "an," and "the" herein are intended to comprise the plural forms as well, unless the context clearly indicates otherwise.

Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. A pixel circuit, comprising:

a driving circuit, configured to provide a driving current to a first node;

a lighting element, comprising a first terminal and a second terminal, wherein the first terminal of the lighting element is coupled with a second node, and the second terminal of the lighting element is configured to receive a system low voltage; and a plurality of switching circuits, coupled between the first node and the second node in a parallel connection, and configured to correspondingly receive a plurality of emission control signals and at least one grayscale control signal, wherein during each frame, the plurality of emission control signals provide a plurality of pulses, and the plurality of pulses do not mutually overlapping in time sequence, so that the plurality of switching circuits selectively couple the first node to the second node according to the plurality of pulses and the at least one grayscale control signal.

2. The pixel circuit of claim 1, wherein the plurality of switching circuits are configured to receive a writing control signal, and are configured to correspondingly receive, according to the writing control signal, a plurality of data voltages from a plurality grayscale control signals of the at least one grayscale control signal, and each of the plurality of switching circuits comprises:

a first switch, comprising a first terminal, a second terminal, and a control terminal, wherein the first terminal of the first switch is coupled with the first node;

a second switch, comprising a first terminal, a second terminal, and a control terminal, wherein the first terminal of the second switch is configured to receive a corresponding one of the plurality of data voltages, the second terminal of the second switch is coupled with the control terminal of the first switch, and the control terminal of the second switch is configured to receive the writing control signal;

a third switch, comprising a first terminal, a second terminal, and a control terminal, wherein the first terminal of the third switch is coupled with the second terminal of the first switch, the second terminal of the third switch is coupled with the second node, and the control terminal of the third switch is configured to receive a corresponding one of the plurality of emission control signals; and a storage capacitor, comprising a first terminal and a second terminal, wherein the first terminal of the storage capacitor is coupled with the control terminal of the first switch, and the second terminal of the storage capacitor is configured to receive a first reference voltage.

3. The pixel circuit of claim 2, wherein each of the plurality of emission control signals provides at least some of the plurality of pulses during each frame, wherein during each frame, a pulse number of a first emission control signal of the plurality of emission control signals is half times of a pulse number of a second emission control signal of the plurality of emission control signals, and the second emission control signal starts to provide the at least some of the plurality of pulses after the first emission control signal.

4. The pixel circuit of claim 1, wherein the plurality of switching circuits are configured to correspondingly receive a plurality of writing control signals, and are configured to receive a plurality of data voltages from the at least one grayscale control signal according to the plurality of writing control signals, and each of the plurality of switching circuits comprises:

a first switch, comprising a first terminal, a second terminal, and a control terminal, wherein the first terminal of the first switch is coupled with the first node;

a second switch, comprising a first terminal, a second terminal, and a control terminal, wherein the first terminal of the second switch is configured to receive a corresponding one of the plurality of data voltages, the second terminal of the second switch is coupled with the control terminal of the first switch, and the control terminal of the second switch is configured to receive a corresponding one of the plurality of writing control signals;

a third switch, comprising a first terminal, a second terminal, and a control terminal, wherein the first terminal of the third switch is coupled with the second terminal of the first switch, the second terminal of the third switch is coupled with the second node, and the control terminal of the third switch is configured to receive a corresponding one of the plurality of emission control signals; and a storage capacitor, comprising a first terminal and a second terminal, wherein the first terminal of the storage capacitor is coupled with the control terminal of the first switch, and the second terminal of the storage capacitor is configured to receive a first reference voltage.

5. The pixel circuit of claim 4, wherein during each frame, each of the plurality of emission control signals provides one of the plurality of pulses, and two pulses adjacent in time sequence of the plurality of pulses have pulse widths having a ratio of 1:2 or of 2:1.

6. The pixel circuit of claim 4, wherein each of the plurality of emission control signals provides at least some of the plurality of pulses during each frame, wherein during each frame, a pulse number of a first emission control signal of the plurality of emission control signals is half times of a pulse number of a second emission control signal of the plurality of emission control signals, and the second emission control signal starts to provide the at least some of the plurality of pulses after the first emission control signal.

7. The pixel circuit of claim 6, wherein the at least some of the plurality of pulses are divided into a plurality of pulse groups in a number average manner, and the first emission control signal provides a corresponding one of the plurality of pulse groups in a predetermined period.

8. A pixel circuit driving method, comprising:

providing a pixel circuit, wherein the pixel circuit comprises:

a driving circuit, configured to provide a driving current to a first node;

a lighting element, comprising a first terminal and a second terminal, wherein the first terminal of the lighting element is coupled with a second node, and the second terminal of the lighting element is configured to receive a system low voltage; and a plurality of switching circuits, coupled between the first node and the second node in a parallel connection;

providing at least one grayscale control signal to the plurality of switching circuits;

correspondingly providing a plurality of emission control signals to the plurality of switching circuits; and during each frame, utilizing the plurality of emission control signals to provide a plurality of pulses, wherein the plurality of pulses do not mutually overlap in time sequence, so that the plurality of switching circuits selectively couple the first node to the second node according to the plurality of pulses and the at least one grayscale control signal.

9. The method of claim 8, wherein the operation of providing the at least one grayscale control signal to the plurality of switching circuits comprises:

correspondingly providing a plurality of grayscale control signals of the at least one grayscale control signal to the plurality of switching circuits; and providing a writing control signal to the plurality of switching circuits, so that the plurality of switching circuits correspondingly receive a plurality of data voltages from the plurality of grayscale control signals, wherein each of the plurality of switching circuits selectively couples the first node and the second node according to a corresponding one of the plurality of pulses and a corresponding one of the plurality of data voltages, wherein if the corresponding one of the plurality of data voltages has a logic high level, when the switching circuit receives the corresponding one of the plurality of pulses, the switching circuit couples the first node to the second node, wherein if the corresponding one of the plurality of data voltages has a logic low level, the switching circuit disconnects the first node from the second node.

10. The method of claim 9, wherein each of the plurality of emission control signals provides at least some of the plurality of pulses during each frame, wherein during each frame, a pulse number of a first emission control signal of the plurality of emission control signals is half times of a pulse number of a second emission control signal of the plurality of emission control signals, and the second emission control signal starts to provide the at least some of the plurality of pulses after the first emission control signal.

11. The method of claim 8, further comprising:

providing the at least one grayscale control signal to the plurality of switching circuits; and correspondingly providing a plurality of writing control signals to the plurality of switching circuits, so that the plurality of switching circuits receive a plurality of data voltages in sequence from the at least one grayscale control signal, wherein each of the plurality of switching circuits selectively couples the first node to the second node according to a corresponding one of the plurality of pulses and a corresponding one of the plurality of data voltages, wherein if the corresponding one of the plurality of data voltages has a logic high level, when the switching circuit receives the corresponding one of the plurality of pulses, the switching circuit couples the first node to the second node, wherein if the corresponding one of the plurality of data voltages has a logic low level, the switching circuit disconnects the first node from the second node.

12. The method of claim 11, wherein during each frame, each of the plurality of emission control signals provides one of the plurality of pulses, and two pulses adjacent in time sequence of the plurality of pulses have pulse widths having a ratio of 1:2 or of 2:1.

13. The method of claim 11, wherein each of the plurality of emission control signals provides at least some of the plurality of pulses during each frame, wherein during each frame, a pulse number of a first emission control signal of the plurality of emission control signals is half times of a pulse number of a second emission control signal of the plurality of emission control signals, and the second emission control signal starts to provide the at least some of the plurality of pulses after the first emission control signal.

14. The method of claim 13, wherein the at least some of the plurality of pulses are divided into a plurality of pulse groups in a number average manner, and the first emission control signal provides a corresponding one of the plurality of pulse groups in a predetermined period.

15. A display device, comprising:

a plurality of pixel circuits, arranged as n rows, wherein n is an integer larger than 1, and each of the plurality of pixel circuits comprises:

a driving circuit, configured to provide a driving current to a first node;

a lighting element, comprising a first terminal and a second terminal, wherein the first terminal of the lighting element is coupled with a second node, and the second terminal of the lighting element is configured to receive a system low voltage; and a plurality of switching circuits, coupled between the first node and the second node in a parallel connection, and configured to correspondingly receive a plurality of emission control signals and at least one grayscale control signal; and a control circuit, configured to provide the plurality of emission control signals and the at least one grayscale control signal, wherein during each frame, the plurality of emission control signals provide a plurality of pulses, and the plurality of pulses do not mutually overlapping in time sequence, so that the plurality of switching circuits selectively couple the first node to the second node according to the plurality of emission control signals and the at least one grayscale control signal.

16. The display device of claim 15, wherein the control circuit is further configured to provide a writing control signal to the plurality of switching circuits, so that the plurality of switching circuits receive a plurality of data voltages from a plurality of grayscale control signals of the at least one grayscale control signal, and each of the plurality of switching circuits comprises:

a first switch, comprising a first terminal, a second terminal, and a control terminal, wherein the first terminal of the first switch is coupled with the first node;

a second switch, comprising a first terminal, a second terminal, and a control terminal, wherein the first terminal of the second switch is configured to receive a corresponding one of the plurality of data voltages, the second terminal of the second switch is coupled with the control terminal of the first switch, and the control terminal of the second switch is configured to receive the writing control signal;

a third switch, comprising a first terminal, a second terminal, and a control terminal, wherein the first terminal of the third switch is coupled with the second terminal of the first switch, the second terminal of the third switch is coupled with the second node, and the control terminal of the third switch is configured to receive a corresponding one of the plurality of emission control signals; and a storage capacitor, comprising a first terminal and a second terminal, wherein the first terminal of the storage capacitor is coupled with the control terminal of the first switch, and the second terminal of the storage capacitor is configured to receive a first reference voltage.

17. The display device of claim 16, wherein each of the plurality of emission control signals provides at least some of the plurality of pulses during each frame, wherein during each frame, a pulse number of a first emission control signal of the plurality of emission control signals is half times of a pulse number of a second emission control signal of the plurality of emission control signals, and the second emission control signal starts to provide the at least some of the plurality of pulses after the first emission control signal.

18. The display device of claim 15, wherein the control circuit is configured to correspondingly provide a plurality of writing control signals to the plurality of pixel circuits, so that the plurality of pixel circuits receive a plurality of data voltages in sequence from the at least one grayscale control signal, and each of the plurality of switching circuits comprises:

a first switch, comprising a first terminal, a second terminal, and a control terminal, wherein the first terminal of the first switch is coupled with the first node;

a second switch, comprising a first terminal, a second terminal, and a control terminal, wherein the first terminal of the second switch is configured to receive a corresponding one of the plurality of data voltages, the second terminal of the second switch is coupled with the control terminal of the first switch, and the control terminal of the second switch is configured to receive a corresponding one of the plurality of writing control signals;

a third switch, comprising a first terminal, a second terminal, and a control terminal, wherein the first terminal of the third switch is coupled with the second terminal of the first switch, the second terminal of the third switch is coupled with the second node, and the control terminal of the third switch is configured to receive a corresponding one of the plurality of emission control signals; and a storage capacitor, comprising a first terminal and a second terminal, wherein the first terminal of the storage capacitor is coupled with the control terminal of the first switch, and the second terminal of the storage capacitor is configured to receive a first reference voltage.

19. The display device of claim 18, wherein during each frame, each of the plurality of emission control signals provides one of the plurality of pulses, and two pulses adjacent in time sequence of the plurality of pulses have pulse widths having a ratio of 1:2 or of 2:1.

20. The display device of claim 18, wherein each of the plurality of emission control signals provides at least some of the plurality of pulses during each frame, wherein during each frame, a pulse number of a first emission control signal of the plurality of emission control signals is half times of a pulse number of a second emission control signal of the plurality of emission control signals, and the second emission control signal starts to provide the at least some of the plurality of pulses after the first emission control signal.

21. The display device of claim 20, wherein the at least some of the plurality of pulses are divided into a plurality of pulse groups in a number average manner, and the first emission control signal provides a corresponding one of the plurality of pulse groups in a predetermined period.

* * * * *